United States Patent [19]

Holman

[11] 3,974,421

[45] Aug. 10, 1976

[54] TELEVISION DEFLECTION COIL

[75] Inventor: Benedictus Timotheus Johannes Holman, Eindhoven, Netherlands

[73] Assignee: U.S. Philips Corporation, New York, N.Y.

[22] Filed: Nov. 6, 1974

[21] Appl. No.: 521,277

[30] Foreign Application Priority Data

Nov. 9, 1973 Netherlands ..... 7315351

[52] U.S. Cl. ..... 315/399; 315/370; 315/393; 315/410; 335/214

[51] Int. Cl.[2] ..... H01J 29/70; H01H 1/00

[58] Field of Search ..... 315/11, 12, 370, 393, 315/399, 410; 335/213, 214

[56] References Cited

UNITED STATES PATENTS

| | | | |
|---|---|---|---|
| 2,689,923 | 9/1954 | Janssen | 335/214 |
| 2,882,446 | 4/1959 | Janssen et al. | 315/393 |
| 3,162,791 | 12/1964 | Gostyn | 335/213 |

FOREIGN PATENTS OR APPLICATIONS

| | | | |
|---|---|---|---|
| 1,190,411 | 5/1970 | United Kingdom | 335/213 |

*Primary Examiner*—T.H. Tubbesing
*Assistant Examiner*—S. C. Buczinski
*Attorney, Agent, or Firm*—Frank R. Trifari; Henry I. Steckler

[57] ABSTRACT

Interference oscillations in the frequency ranges around 0.2 MHz and 1 MHz are eliminated in a deflection coil by the provision of an additional circuit element. The additional circuit element can be formed by an additional electrically conductive foil which is connected to the current supply side of the line coil sections or by a capacitor which connects this supply line to the central contacts of the series-connected frame coil sections. The connection of the coil sections with respect to each other should usually be adapted to the winding sense of the coil sections so as to ensure proper elimination of the interference oscillations.

5 Claims, 7 Drawing Figures

TELEVISION DEFLECTION COIL

Figure 1:
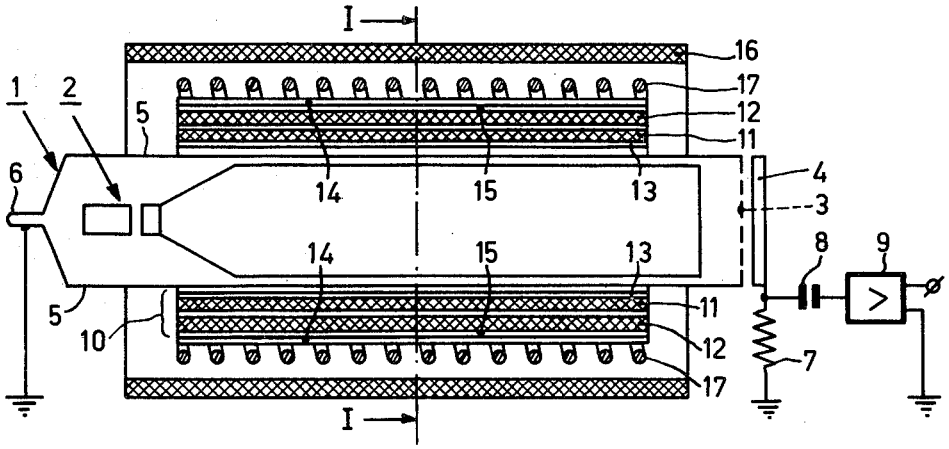

The invention relates to a deflection coil comprising a line deflection coil composed of two line coil sections and a frame deflection coil composed of two frame coil sections for the scanning of a target in a cathode ray tube by means of an electron beam.

In known deflection coils which are used, for example, for television camera tubes, difficulties are often encountered in the form of interference oscillations in the deflection currents, which are situated in frequency ranges around approximately 0.2 MHz and around 1 MHz. In a colour television camera unequal frame distortions will occur for the various camera tubes, thus disturbing the correct superimposition of the colour images. The said interference oscillations in television camera tubes often also cause electrical signals in the video amplifier, so that brightness disturbances occur in the image formation.

The invention has for its object to eliminate the said interference oscillations and is based on recognition of the cause of these interference oscillations. For a proper understanding of this cause, it is to be noted that the coil sections can be wound clockwise or counter-clockwise, and that the pairs of coil sections constituting a deflection coil may consist of sections which are wound in the same direction or of sections which are wound in opposite directions. The following possibilities exist for a deflection coil comprising two line coil sections and two frame coil sections:

Both line coil sections wound clockwise and both frame coil sections wound clockwise; both line coil sections wound clockwise and both frame coil sections wound counter-clockwise; both line coil sections wound clockwise and one of the frame coil sections wound clockwise and the other section wound counter-clockwise; both line coil sections wound counter-clockwise, in conjunction with each of the three said situations for the frame coil sections; one of the line coil sections wound clockwise and one section wound counter-clockwise, again in conjunction with each of the said three situations for the frame coil sections. In deflection coils in which one of the line coil sections is wound clockwise and the other is wound counter-clockwise, for each winding situation of the frame coil sections the cause of the 0.2 MHz interference oscillations is absent, and only the 1 MHz interference oscillations need be eliminated. Furthermore, the coil sections of a deflection coil can be connected in parallel or in series. In deflection coils used in practice, the line coil sections are usually connected in parallel, whilst the frame coil sections are usually connected in series.

The causes of the 0.2 MHz interference oscillations can usually be found in the feasibility of excitation of the frame deflection coil by the line deflection signal, this coil in this case consisting of series-connected frame coil sections for the frame deflection voltage which have a given winding sense and which have connected parallel thereto a capacitance which is preferably earthed and which forms a static screen. The feasibility of excitation may then relate to:

a. A capacitive coupling of the line deflection coil to the frame deflection coil. This possibility can be eliminated by a suitable static screen.

b. A normal magnetic coupling between the line deflection coil and the frame deflection coil. Because this coupling can be adjusted to zero, the causes thereof can be ignored for practical arrangements.

c. A special magnetic coupling between the line deflection coil and a frame coil section which is caused by a combination of the below factors. The use of line coil sections having the same winding sense, and currents which are generated in this parallel-connected section due to static screens which constitute distribution capacitances in conjunction with the line deflection coil sections and which are instantaneously directed inwards or outwards in the wire ends of each line deflection section. As a result, electrical voltages are generated in the frame deflection sections which are series-connected for the frame deflection voltage, the said voltages being instantaneously directed towards or away from the central contact of these coil sections.

The cause of the 1 MHz interference oscillation can be found in the cooperation of a line coil section with the static screening thereof. The screening behaves as a distribution capacitance between the turns of the line coil sections and earth. In a first approximation these capacitances act as a sum capacitance parallel to the line deflection coil. However, because the magnetic coupling between the turns of each line coil section individually is not complete, the combination of line coil section and screening behaves in a frequency range around 1 MHz such that series resonance occurs. As a result, currents flow through the coil section halves which, viewed from the centre of a coil section, are alternately directed outwards and inwards on both sides. In practical television camera tubes comprising a separate gauze electrode and a double gauze connection wire, the magnetic alternating fields associated with these currents generate voltages which are added to the video signal as interference.

The invention has for its object to eliminate the described interference oscillations, and to this end a deflection coil of the kind set forth according to the invention is characterized in that an electrical circuit element is added which is connected to the voltage-carrying side of the line coil sections.

When according to the invention an additional electrical screening foil is provided in the line deflection coil and when this foil is connected only to the voltage-carrying side of the line coil sections, the cause of the 0.2 MHz as well as the 1 MHz interference oscillations is removed.

When a capacitor is connected between the voltage-carrying side of the line coil sections and the central contact of the series-connected line coil sections in a coil system comprising line deflection coils having coil sections of the same winding sense according to the invention, the 0.2 MHz interference oscillations can be fully eliminated by compensation if the frame coil sections are correctly interconnected. The capacitance of the capacitor should then notably be adapted to the effectively active inductance of the frame coil sections and the capacitance between the screening and the line coil sections.

Some preferred embodiments of coil systems according to the invention will be described in detail hereinafter with reference to the drawing.

Figure 2:
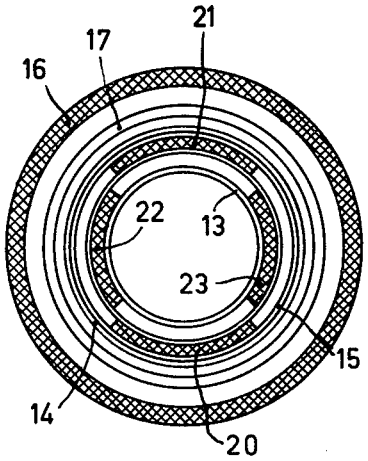
Figure 3:
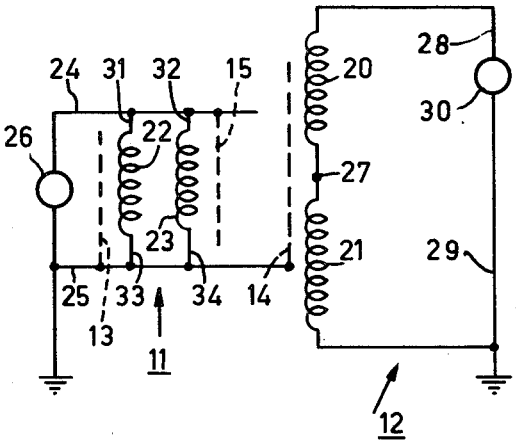
Figure 4:
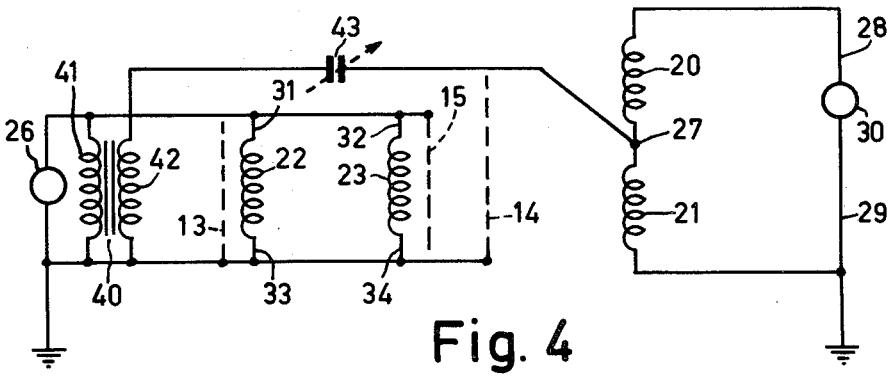
Figure 5:
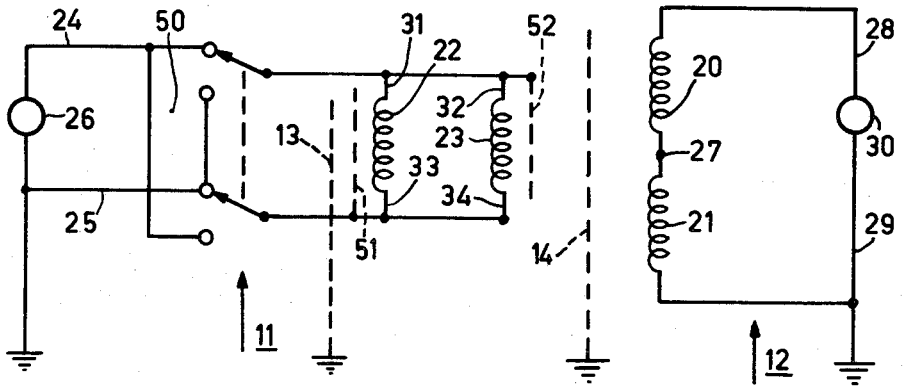
Figure 6:
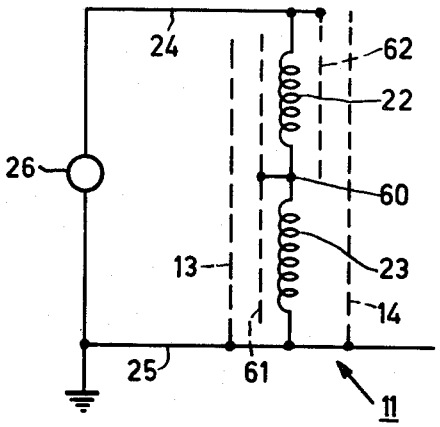
Figure 7:
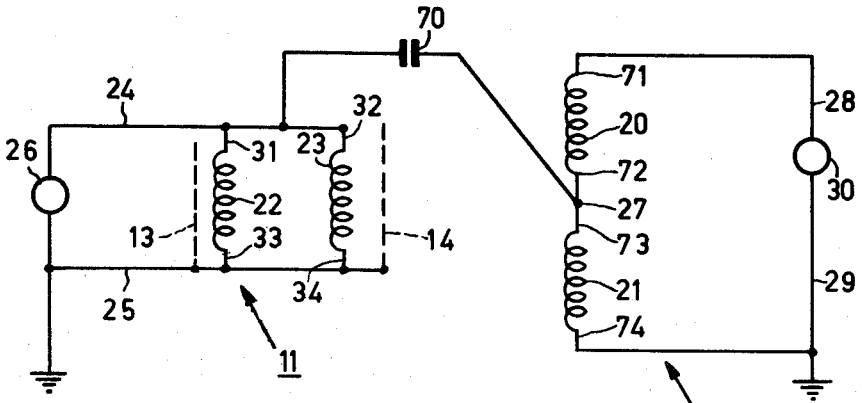

FIG. 1 is a diagrammatic representation of a television camera tube comprising a deflection coil according to the invention, FIG. 2 diagrammatically shows a cross-section of the deflection coil of FIG. 1 taken according to the line I—I, FIG. 3 diagrammatically shows an electrical equivalent diagram of a deflection coil according to the invention, provided with an additional, electrically conductive foil which is connected to a current supply lead of the line coil sections, FIG. 4 shows a preferred embodiment comprising a circuit for compensating 0.2 MHz residual interference occurring due to capacitive coupling in the line deflection coil, FIG. 5 shows a preferred embodiment for use for reversed line scanning, FIG. 6 shows a preferred embodiment for series-connected line coil sections, and FIG. 7 shows a preferred embodiment in which a capacitor is incorporated to compensate for the 0.2 MHz interference oscillations.

The arrangement according to FIG. 1 includes a television tube 1 of the vidicon type, comprising an electron gun 2, a gauze electrode 3 and a target 4. The gauze electrode 3 is connected, via a connection lead 5 which in practical camera tubes is often constructed in the form of two wires which are diametrically arranged in the tube, to a passage pin 6 of the camera tube. Across a signal resistor 7, a signal is applied from the target 4, via a capacitor 8, to a video amplifier 9. Arranged about the camera tube is a deflection coil 10 comprising a line deflection coil 11, a frame deflection coil 12, electrical screens 13 and 14 and, according to the invention, an additional electrically conductive foil 15. Also provided about the camera tube are a focussing coil 16 and a ferromagnetic coil former 17 which inter alia serves to intensify the deflection fields.

FIG. 2 is a diagrammatic, cross-sectional representation of the frame deflection coil 12, consisting of two sections 20 and 21, the line deflection coil 11, also consisting of two sections 22 and 23, the two commonly used earthed electrical screens 13 and 14, and the additional circuit element 15 which preferably consists of a metal foil in which no or substantially no eddy currents can occur and which is connected to the voltage-carrying side of the line coil sections according to the invention.

The electrical circuit diagram of FIG. 3 shows the line coil sections 22 and 23, the earthed screens 13 and 14, and the additional foil 15. An inner lead-out wire 31 and an outer lead-out wire 32 of the line coil sections having the same winding sense are alternately connected to a voltage-carrying wire 24, the other ends 33 and 34 of each of the sections being connected to a wire 25 which is earthed in practice. Connected to this earthed wire are the commonly used screens 13 and 14, whilst the foil 15 is connected to the supply wire 24. A control source 26 for the line deflection coil is connected between the wires 24 and 25.

The frame deflection coil 12 shown in FIG. 3 comprises the two frame coil sections 20 and 21 which are connected in series for the primary frame deflection signal and a central contact 27 and a control source 30, connected between a voltage-carrying wire 28 and an earthed wire 29, for the frame coil sections. For proper elimination of the 1 MHz interference oscillations, the capacitance between the screen 13 and the line deflection coil, and that between the foil 15 and the line deflection coil, must be equal or substantially equal. Since the cause of these interference oscillations is removed by the insertion of the additional circuit element 15, the interference oscillations in the 0.2 MHz range as well as in the 1 MHz range are eliminated. In a practical embodiment, a capacitive residual coupling between the line deflection coil and the frame deflection coil can have a disturbing effect. This interference capacitance is compensated for in a circuit shown in FIG. 4 by the addition of a transformer 40 which is formed, for example, by a pot-core transformer. A winding 41 of the transformer 40 connects the wire 24 to the wire 25, a second winding 42 being connected on the one side to the wire 25 and on the other side, via a capacitor 43, to the central contact 27 of the frame coil sections. By means of this transformer a line coil balance control is essentially simulated for the effects concerned. If a coil system incorporates a ferromagnetic coil former (17), the latter is preferably used as a magnetic core for a phase-reversing transformer. In a known arrangement it is then merely necessary to arrange at least one wire turn thereof about at least a part of the jacket of the coil former, i.e. at the area where the line return field in the coil former is comparatively strong.

FIG. 5 shows a preferred embodiment according to the invention in which reversed line scanning can be used while maintaining proper elimination of the interference oscillations. The functioning of the output wire 25 and the input wire 24 is alternated by a commutating switch 50, and one of the foils 51 and 52 is alternately connected such that it takes over the function of the additional circuit element 15. Independent of the switching positions, the normal screens 13 and 14 must then always be earthed.

In deflection coils for special applications it may be desirable to connect the line coil sections in series. The principle of the invention can also be used for the elimination of interference oscillations. FIG. 6 shows a circuit diagram for this embodiment. The line coil sections 22 and 23 are interconnected via a central contact 60, and are controlled by the control source 26 via the voltage-carrying wire 24 and the earthed wire 25. The screens 13 and 14 are connected to the earthed wire 25, whilst there are furthermore provided a foil 61, connected to the central contact 60, and a foil 62 which is connected to the wire 24. As was already stated, the 0.2 MHz interference oscillations do not appear in a deflection coil having parallelconnected line coil sections of opposite winding sense, because the relevant cause is absent.

However, the 1 MHz interference oscillations will occur therein, so that the provision of the additional circuit element in the form of a foil which is connected to the current supply line for the line coil sections still makes sense.

FIG. 7 shows a preferred embodiment for the compensation of the 0.2 MHz oscillations in a deflection coil comprising parallel-connected line coil sections and series-connected frame coil sections. The line deflection coil consists of line coil sections having the same winding sense, the outer lead-out wire 31 and the inner lead-out wire 32 thereof being alternately connected again to the current supply wire 24, the inner lead-out wire 33 and the outer lead-out wire 34 being connected to the earthed wire 25. When a capacitor 70 having an adapted capacitance is connected as the additional circuit element between the current supply wire 24 of the line coil sections and the central contact of the frame coil sections, and when the frame coil sections are interconnected in a given manner, the 0.2 MHz interference oscillations can be eliminated.

To this end, in the case of clockwise wound line coil sections, when the frame coil sections are also clockwise wound, the inner lead-out wires should join at the central contact 27; in the case of counter-clockwise wound frame coil sections, the outer lead-out wires should join at this contact, and in the case of frame coil sections wound in opposite sense, the inner lead-out wire of the clockwise wound section and the outer lead-out wire of the counter-clockwise wound section should join at this contact.

To this end, in the case of counter-clockwise wound line coil sections, when the frame coil sections are also counter-clockwise wound, the inner lead-out wires should join at the central contact 27; in the case of clockwise wound frame coil sections, the outer lead-out wires should join at this contact, and in the case of frame coil sections which are wound in opposite sense, the inner lead-out wire of the counter-clockwise wound section and the outer lead-out wire of the clockwise wound section should join at this contact. The capacitance of the capacitor 70 can be empirically adjusted to the optimum value. To this end, it will preferably be constructed as a variable capacitor. The capacitance can also be calculated to a good approximation by assuming the sum voltage of the voltages introduced on the central contact 27 by the special magnetic coupling and by the capacitor 70 to be equal to 0.

What is claimed is:

1. A deflection coil comprising a line deflection coil having two line coil sections, each having at least a voltage carrying lead and a frame deflection coil having two frame coil sections for the scanning of a target in a cathode ray tube by means of an electron beam, an electrical circuit element coupled to the voltage-carrying leads of the line coil sections, the circuit element including an electrically conductive foil.

2. A deflection coil comprising a line deflection coil having two line coil sections, each having at least a voltage carrying lead and a frame deflection coil having two frame coil sections for the scanning of a target in a cathode ray tube by means of an electron beam, an electrical circuit element coupled to the voltage-carrying leads of the line coil sections, said line coil sections each having an earthed lead, commutator switch means for alternating the function of the voltage-carrying lead and the earthed lead, the circuit element including an electrically conductive foil coupled to the voltage-carrying lead and another electrically conductive foil coupled to the earthed lead.

3. A deflection coil comprising a line deflection coil having two line coils sections, each having at least a voltage carrying lead and a frame deflection coil having two frame coil sections for the scanning of a target in a cathode ray tube by means of an electron beam, an electrical circuit element coupled to the voltage-carrying leads of the line coil sections, said line coil sections having an earthed lead, said frame coil sections having a central contact, and a transformer coupled between the voltage-carrying lead and the earthed lead for the line coil sections, one winding lead-out of said transformer being coupled to the central contact of the frame coil sections.

4. A deflection coil as claimed in claim 3, wherein at least a part of a ferromagnetic screening coil former for the deflection coil acts as the core for the transformer.

5. A deflection coil comprising a line deflection coil having two line coil sections, each having at least a voltage carrying lead and a frame deflection coil having two frame coil sections for the scanning of a target in a cathode ray tube by means of an electron beam, an electrical circuit element coupled to the voltage-carrying leads of the line coil sections, the line coil sections being coupled in series and comprise two electrically conductive foils, one of said foils is coupled to the central contact of the line coil sections, the other of said foils is coupled to the voltage-carrying lead for the line coil sections.

* * * * *